US010888914B2

(12) United States Patent
Ellerbrock et al.

(10) Patent No.: US 10,888,914 B2
(45) Date of Patent: Jan. 12, 2021

(54) ADJUSTMENT ASSEMBLY FOR A PRESS APPARATUS

(71) Applicant: Eaton Corporation, Cleveland, OH (US)

(72) Inventors: Ryan Ellerbrock, Continental, OH (US); Bob Laipply, Spring Arbor, MI (US)

(73) Assignee: Eaton Corporation, Cleveland, OH (US)

( * ) Notice: Subject to any disclaimer, the term of this patent is extended or adjusted under 35 U.S.C. 154(b) by 306 days.

(21) Appl. No.: 15/884,722

(22) Filed: Jan. 31, 2018

(65) Prior Publication Data

US 2018/0214926 A1 Aug. 2, 2018

Related U.S. Application Data

(60) Provisional application No. 62/453,364, filed on Feb. 1, 2017.

(51) Int. Cl.
*B21D 41/00* (2006.01)
*B21D 39/04* (2006.01)

(52) U.S. Cl.
CPC ..... *B21D 39/048* (2013.01); *B21D 39/046* (2013.01)

(58) Field of Classification Search
CPC ..... B21J 9/06; B21D 41/04; B21D 39/048; B21D 39/046; G01B 3/28; G01B 5/18; Y10T 29/53996
USPC ..... 72/399, 402, 31.06, 20.1–21.6, 712; 33/813, 814; 29/282, 283.5, 715, 753, 29/761, 788, 861, 33 M
See application file for complete search history.

(56) References Cited

U.S. PATENT DOCUMENTS 1,922,758 A * 8/1933 Christopherson ..... G01B 3/28 33/544
2,791,034 A * 5/1957 Handy ..... G01B 3/18 33/813
3,720,088 A * 3/1973 Pauly ..... B21D 17/02 72/402

(Continued)

OTHER PUBLICATIONS

Kuriyama of America Inc., "Crimp Specifications for Hydraulic Hose and Fittings", Jul. 27, 2016, Kuriyama of America Inc. (Year: 2016).*

(Continued)

*Primary Examiner* — Adam J Eiseman
*Assistant Examiner* — Dylan Schommer
(74) *Attorney, Agent, or Firm* — Merchant & Gould P.C.

(57) ABSTRACT

A variable crimp machine includes an actuator adjustment assembly including a dial that rotates about an actuation axis and a barrel positioned along the actuation axis within the dial. The barrel includes a first set of axially spaced markings corresponding to a first hose and a second set of axially spaced markings correspond to a second hose. The dial includes a first set of circumferentially spaced markings corresponding to the first hose and a second set of circumferentially spaced markings corresponding to the second hose. The first set of circumferentially spaced markings are used in concert with the first set of axially spaced markings to adjust an actuator for use with the first hose, and the second set of circumferentially spaced markings are used in concert with the second set of axially spaced markings to adjust the actuator for use with the second hose.

20 Claims, 13 Drawing Sheets

(56) References Cited

U.S. PATENT DOCUMENTS

| | | | | | |
|---|---|---|---|---|---|
| 4,331,019 | A * | 5/1982 | Smith | B21D 39/046 | 29/237 |
| 4,790,173 | A * | 12/1988 | Boutcher, Jr. | B30B 15/0035 | 100/257 |
| 5,056,351 | A * | 10/1991 | Stiver | B21D 39/046 | 100/257 |
| 5,937,510 | A * | 8/1999 | Seiersen | H01R 43/0488 | 29/751 |
| 6,041,685 | A * | 3/2000 | Dick | B26D 7/26 | 100/257 |
| 6,519,867 | B1 * | 2/2003 | Saeki | G01B 3/18 | 33/679.1 |
| 6,604,280 | B2 * | 8/2003 | Carlotto | H01R 43/0488 | 29/747 |
| 7,370,408 | B2 * | 5/2008 | Deming | H01R 43/055 | 29/33 M |
| 2005/0056076 | A1 * | 3/2005 | Curry | B21D 39/046 | 72/402 |

OTHER PUBLICATIONS

Extended European Search Report for Application No. 18154301.8 dated Jun. 29, 2018.

* cited by examiner 410 202 300

408

| HOSE | FITTING | DIES |
|---|---|---|
| GH681-4 | TTC | M150 |
| GH681-6 | TTC | M180 |
| GH681-8 | TTC | M210 |
| GH681-10 | TTC | M240 |
| GH681-12 | TTC | M280 |
| GH681-16 | TTC | M370 |

| HOSE | FITTING | DIES |
|---|---|---|
| GH781-4 | TTC | M150 |
| GH781-6 | TTC | M210 |
| GH781-8 | TTC | M240 |
| GH781-10 | TTC | M280 |
| GH781-12 | TTC | M320 |
| GH781-16 | TTC | M370 |

| HOSE | FITTING | DIES |
|---|---|---|
| GH493-6 | TTC 12 | M210 |
| GH493-8 | TTC 12 | M280 |
| GH493-10 | TTC 12 | M280 |
| GH493-12 | 4S | M320 |
| GH493-16 | 4S | M420 |

FIG.15

ADJUSTMENT ASSEMBLY FOR A PRESS APPARATUS

CROSS REFERENCE TO RELATED APPLICATIONS

The present application claims the benefit of priority to U.S. Provisional Patent No. 62/453,364, titled "ADJUSTMENT ASSEMBLY FOR A PRESS APPARATUS," and filed on Feb. 1, 2017, the disclosure of which is hereby incorporated by reference in its entirety.

BACKGROUND

The present disclosure relates generally to a press-type machine apparatus, and more specifically, to an actuator adjustment assembly for a variable crimp machine.

Press-type machines are used for many different purposes in industry. Press-type machines can apply significant amounts of force, via a power supply, such as an air/hydraulic pump, an electrical pump, and a hand pump, to work pieces and to manipulate the work piece in a given way. At least some known press-type machines include crimp machines that facilitate joining a fitting assembly to a hose. Given the wide variety of sized and shaped fitting assemblies and hoses, adjustment of the crimp machines to match the various hose types facilitates ease of use and efficiency of the machine.

SUMMARY

Aspects of the present disclosure relate to a variable crimp machine for crimping fittings on hoses. The variable crimp machine includes a first frame including an upper actuator mount and a lower crimp ring. An actuator that mounts at the upper actuator mount, the actuator including a driven component that reciprocates linearly along an actuation axis which extends between the upper actuator mount and the lower crimp ring, the driven component including a lower end positioned below the upper actuator mount. A second frame that attaches to the lower end of the driven component, the second frame defining a crimp die set mounting location. An actuator adjustment assembly including a dial that rotates about the actuation axis, the actuator adjustment assembly also including a barrel positioned along the actuation axis within the dial, the dial being configured to move axially relative to the barrel along the actuation axis as the dial is rotated about the actuation axis. The actuator adjustment assembly also includes the barrel including a first set of axially spaced-apart hose size markings corresponding to a first type of hose and a second set of axially spaced-apart hose size markings correspond to a second type of hose. The dial includes a first set of circumferentially spaced-apart hose size markings corresponding to the first type of hose and a second set of circumferentially spaced-apart hose size markings corresponding to the second type of hose. The first set of circumferentially spaced-apart hose size markings are used in concert with the first set of axially spaced-apart hose size markings to adjust the actuator for use with the first type of hose, and the second set of circumferentially spaced-apart hose size markings are used in concert with the second set of axially spaced-apart hose size markings to adjust the actuator for use with the second type of hose.

Another aspect of the present disclosure relates to the first set of circumferentially spaced-apart hose size markings coded with respect to the first set of axially spaced-apart hose size markings, and the second set of circumferentially spaced-apart hose size markings coded with respect to the second set of axially spaced-apart hose size markings.

Another aspect of the present disclosure relates to the first set of circumferentially spaced-apart hose size markings color coded with respect to the first set of axially spaced-apart hose size markings, and the second set of circumferentially spaced-apart hose size markings color coded with respect to the second set of axially spaced-apart hose size markings.

Still another aspect of the present disclosure relates to a generic set of measurement scale markings spaced circumferentially on the dial and a corresponding generic set of measurement scale markings spaced axially on the barrel, and the generic set of measurement scale markings being interspersed with the first set of circumferentially spaced-apart hose size markings and the second set of circumferentially spaced-apart hose size markings.

Another aspect of the present disclosure relates to a plurality of crimp die sets that can be mounted at the crimp die set mounting locations, the crimp die sets correspond to different hose sizes, and a set of crimp die set markings, the crimp die set markings relating crimp die sets to hose sizes.

Another aspect of the present disclosure relates to the first set of circumferentially spaced-apart hose size markings that are coded with respect to the first set of axially spaced-apart hose size markings and to the crimp die set markings, and the second set of circumferentially spaced-apart hose size markings that are coded with respect to the second set of axially spaced-apart hose size markings and to the crimp die set markings.

Still another aspect of the present disclosure relates to a set of crimp die set markings, the crimp die set markings relating crimp die sets to hose sizes and to fitting assemblies.

Another aspect of the present disclosure relates to the first and second sets of axially spaced-apart hose size markings being circumferentially offset from one another, and the barrel can be rotated about the actuation axis to selectively face either the first or second set of axially spaced-apart hose size markings at a front side of the variable crimp machine.

Another aspect of the present disclosure relates to the dial being threadably coupled to the driven component so as to drive axial movement of the dial when rotated about the actuation axis.

Still another aspect of the present disclosure relates to the dial including an oblique section proximate an upper end, the first set of circumferentially spaced-apart hose size markings and the second side of circumferentially spaced-apart hose size markings interspersed on the oblique section.

Another aspect of the present disclosure relates to the barrel being rotatable about the actuation axis, and the dial is rotatable in relation to both the driven component and the barrel.

Another aspect of the present disclosure relates to a pinch point hat coupled to the second frame and at least partially surrounding the dial thereby restricting access to a lower end of the dial.

Further aspects of the present disclosure relate to an actuator adjustment assembly for a variable crimp machine. The actuator adjustment assembly includes a dial that is rotatable about an actuation axis, the dial threadably engageable with a driven component of the variable crimp machine that reciprocates linearly along the actuation axis. A barrel disposed at least partially between the dial and the driven component, such that as the dial is rotated about the actuation axis, the dial moves axially relative to the barrel along the actuation axis. The dial including a plurality of circumferentially spaced-apart hose size markings corresponding to a plurality of hose types. The barrel including a plurality of axially spaced-apart hose size markings corresponding to the plurality of hose types. The plurality of circumferentially spaced-apart hose size markings being used in concert with the plurality of axially spaced-apart hose size markings to adjust an extension length of the driven component.

Another aspect of the present disclosure relates to the plurality of circumferentially spaced-apart hose size markings including two or more marking sets and the plurality of axially spaced-apart hose size markings including two or more marking sets, and corresponding markings sets between the plurality of circumferentially spaced-apart hose size marking and the plurality of axially spaced-apart hose size markings are coded.

Another aspect of the present disclosure relates to corresponding marking sets between the plurality of circumferentially spaced-apart hose size marking and the plurality of axially spaced-apart hose size marking being color coded.

Still another aspect of the present disclosure relates to a set of crimp die set markings that relate crimp die sets to hose sizes and fitting assemblies, and the plurality of circumferentially spaced-apart hose size markings include two or more marking sets and the plurality of axially spaced-apart hose size markings include two or more marking sets, and the set of crimp die set markings are coded to corresponding marking sets between the plurality of circumferentially spaced-apart hose size markings and the plurality of axially spaced-apart hose size markings.

DRAWINGS

FIG. 15 is a detail view of an exemplary set of crimp die set markings that may be used with the actuator adjustment assembly shown in FIGS. 11-14.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
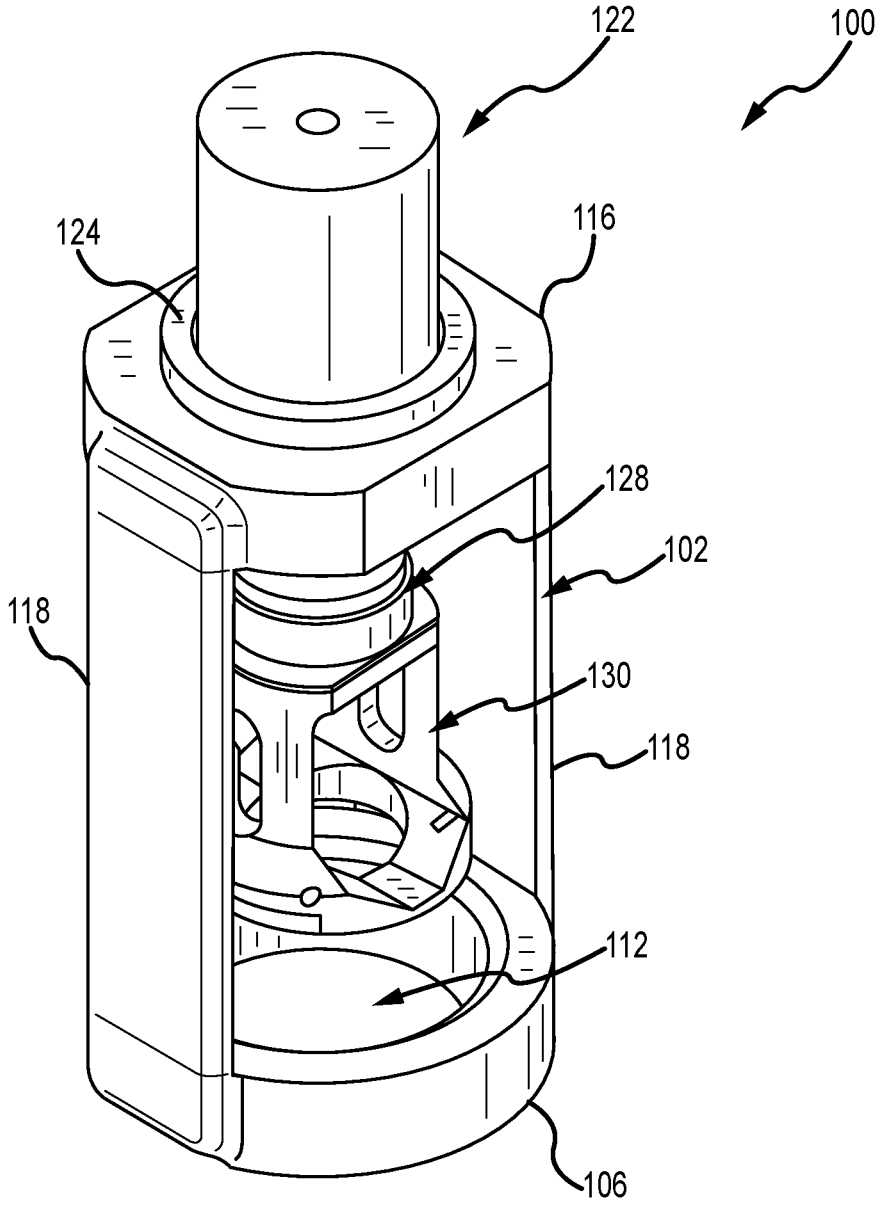
FIG. 1 is a perspective view of a press apparatus having exemplary features of aspects in accordance with the principles of the present disclosure.
Figure 2:
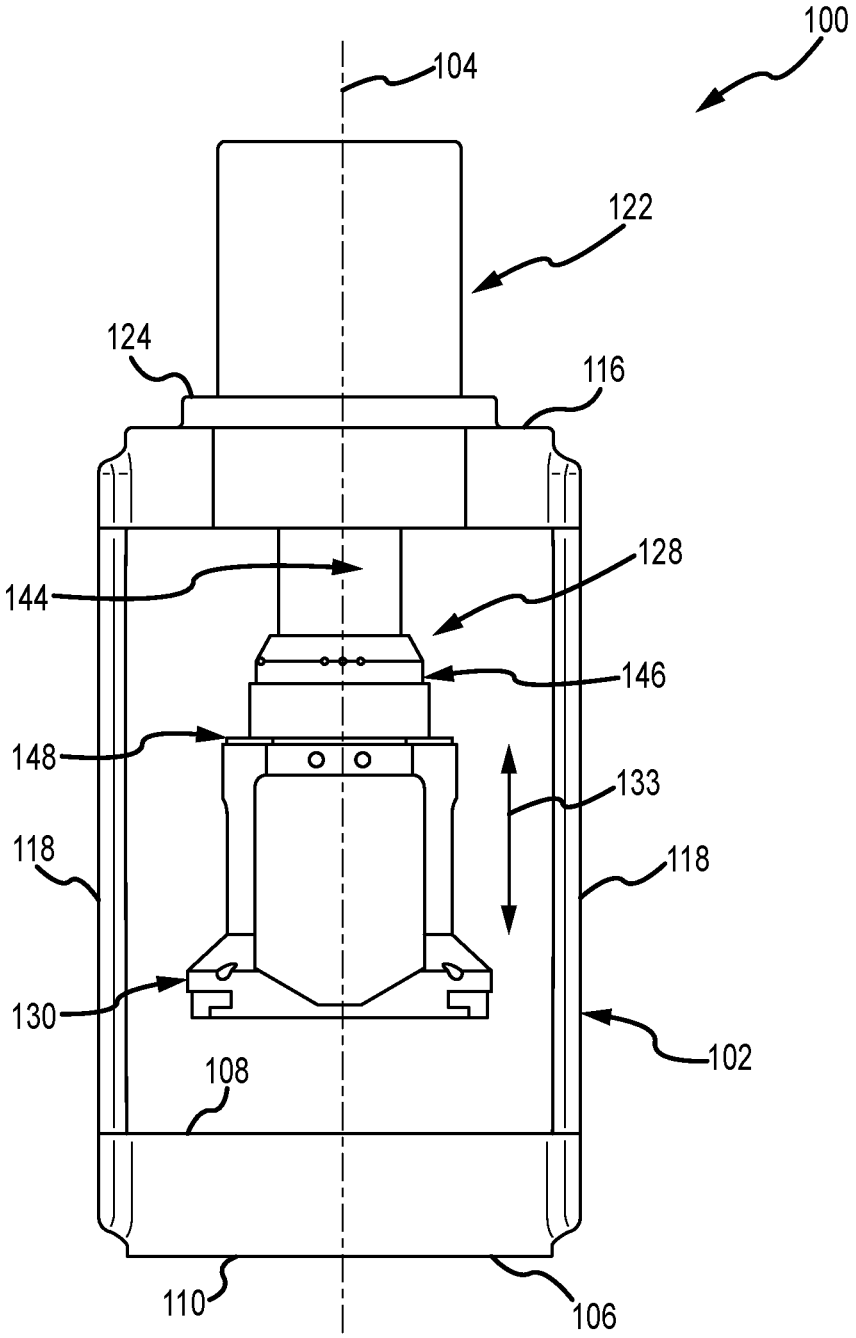
FIG. 2 is a front view of the press apparatus shown in FIG. 1.
Figure 3:
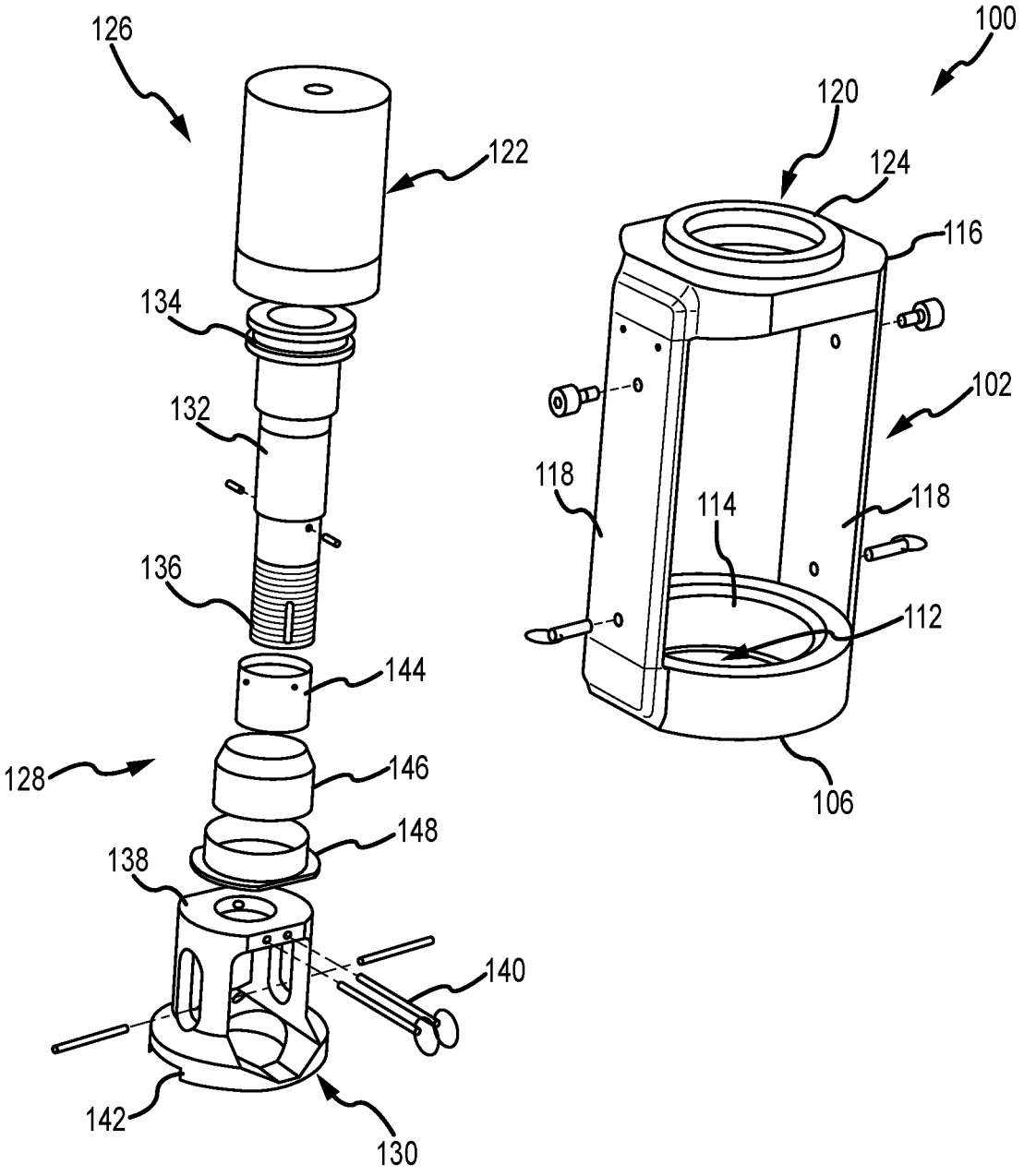
FIG. 3 is an exploded view of the press apparatus shown in FIG. 1.

FIG. 1 is a perspective view of an exemplary press apparatus 100. FIG. 2 is a front view of the press apparatus 100. FIG. 3 is an exploded view of the press apparatus 100. In the exemplary embodiment, the press apparatus 100 is a variable crimping machine that facilitates joining a fitting assembly 202 (shown in FIG. 8) to a hose 204 (shown in FIG. 8).

Referring to FIGS. 1-3, the press apparatus 100 includes a first frame 102, one example of the first frame 102 may be a crimp ring weldment, which extends along a longitudinal or actuation axis 104. The first frame 102 includes a crimp ring 106 having a first surface 108 and an axially opposite second surface 110. A central bore 112 is defined within the crimp ring 106 and has an annular inner surface 114. The annular inner surface 114 is tapered so that an inner diameter of the inner surface 114 at the first surface 108 is greater than an inner diameter of the inner surface 114 at the second surface 110. The central bore 112 is adapted to receive a die assembly 300 (shown in FIGS. 9 and 10).

The first frame 102 also includes an actuator mount 116 opposite the crimp ring 106. The actuator mount 116 is coupled to the crimp ring 106 via a plurality of axially extending side straps 118. A bore 120 is defined within the actuator mount 116 and is adapted to receive and support an actuator 122, for example, via a threaded mounting collar 124.

The press apparatus 100 also includes a press assembly 126 coupled to the first frame 102 and disposed at least partially therein. The press assembly 126 includes the actuator 122, an actuator adjustment assembly 128, and a second frame 130. One example of the second frame 130 may be a pusher formed as a casting or a machined piece. The actuator 122 includes a driven component 132 that reciprocates linearly 133 along the actuation axis 104, which extends between the actuator mount 116 and the crimp ring 106, between an extended position and a retracted position. The driven component 132 includes a first end 134 that is at least partially disposed within the actuator 122 and a second end 136 opposite the first end 134 and positioned between the actuator mount 116 and the crimp ring 106. The driven component second end 136 is coupled to a first end 138 of the second frame 130 via at least one pin 140. The second frame 130 also includes a second end 142 opposite the first end 138 that defines a mounting location for die assembly 300. In the exemplary embodiment, the actuator 122 and driven component 132 may be a cylinder and a piston that is driven by, for example, but not limited to, a hand pump, an air/hydraulic power unit, a hydraulic power source, or an electric power source. In alternative embodiments, the actuator 122 and driven component 132 may be any other linear movement assembly that enables the press apparatus 100 to function as described herein.

The actuator adjustment assembly 128 includes a barrel 144, an adjustable knob or dial 146, and a pinch point hat 148. The barrel 144 is an annular cylinder that is rotatably coupled around the driven component 132. For example, the barrel 144 is rotatably coupled to the driven component 132 via a ball nose spring plunger (not shown). The barrel 144 is positioned on the driven component 132 such that the barrel 144 is restricted from axial movement along the actuation axis 104, but is rotatable about the actuation axis 104. The adjustable dial 146 is an annular cylinder with an annular frustoconical nose that is rotatably coupled around the driven component 132 and the barrel 144. For example, the dial 146 is threaded to the driven component 132 and surrounds the barrel 144. The dial 146 is positioned on the driven component 132 such that the dial 146 may axially move along the actuation axis 104. The dial 146 is also rotatable about the actuation axis 104 in relation to both the driven component 132 and the barrel 144. The pinch point hat 148 is an annular cylinder with flanges extending from one end. The pinch point hat 148 is coupled to the first end 138 of the second frame 130 and receives at least part of the driven component 132 and adjustable dial 146 therethrough. The driven component 132 may move axially and the adjustable dial 146 may move axially and rotationally in relation to the pinch point hat 148.

In operation, to join the fitting assembly 202 to the hose 204, the die assembly 300 is coupled to the second frame 130. The actuator adjustment assembly 128 is adjusted for the hose size and type to define an extension length of the driven component 132 along the actuation axis 104 towards the crimp ring 106. The fitting assembly 202 and the hose 204 are positioned within the crimp ring 106. The driven component 132 may be actuated by the actuator 122 to move from a retracted position (shown in FIGS. 1 and 2) to an extension position (not shown) thereby actuating the die assembly 300 into a crimp position and crimp the fitting assembly 202 to the hose 204. The driven component 132 is then moved back into the retracted position to restart the crimping process.

Figure 4:
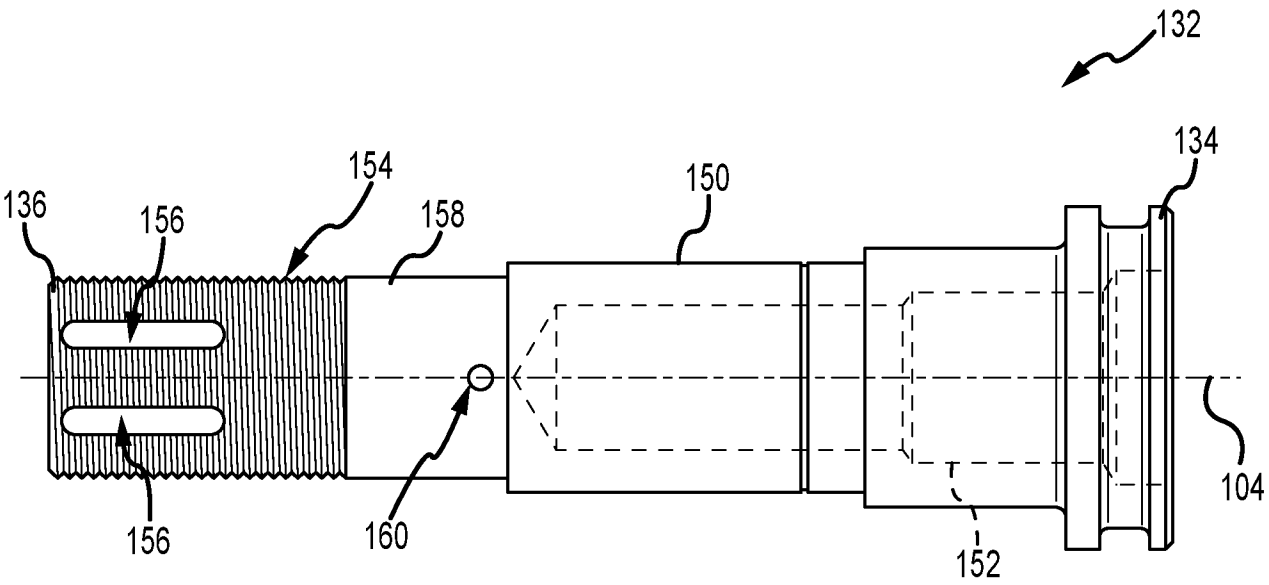
FIG. 4 is a side view of an exemplary driven component that may be used with the press apparatus shown in FIGS. 1-3.

FIG. 4 is a side view of an exemplary driven component 132 that may be used with the press apparatus 100 (shown in FIGS. 1-3). The driven component 132 includes a body 150 that extends from the first end 134 to the second end 136 along the actuation axis 104. The body 150 is cylindrical and in a stepped arrangement from the first end 134 to the second end 136. The first end 134 is actuatable by the actuator 122 (shown in FIGS. 1-3) so as to move the body 150 along the actuation axis 104. The first end 134 may include a recess 152 defined therein to facilitate actuation of the body 150 by the actuator 122.

The second end 136 of the driven component 132 includes a threaded section 154 and a pair of openings 156 defined therethrough. The threaded section 154 extends for a length along the actuation axis 104 and receives corresponding threads of the adjustable dial 146. The openings 156 extend for a length along the actuation axis 104 and receives pin 140 (shown in FIG. 3) to facilitate coupling the driven component 132 to the second frame 130. As the openings 156 extend axially along the actuation axis 104, the second frame 130 may be axially moveable along this same length to facilitate the rotation and axial movement of the adjustable dial 146 as described in further detail below. Adjacent the threaded section 154, the second end 136 also includes a barrel section 158. In the exemplary embodiment, the threaded section 154 has a substantially similar outside diameter to the barrel section 158. The barrel section 158 receives the barrel 144 and includes at least one recess 160 defined therein for the corresponding ball nose spring plunger to rotatably couple the barrel 144 to the second end 136.

Figure 6:
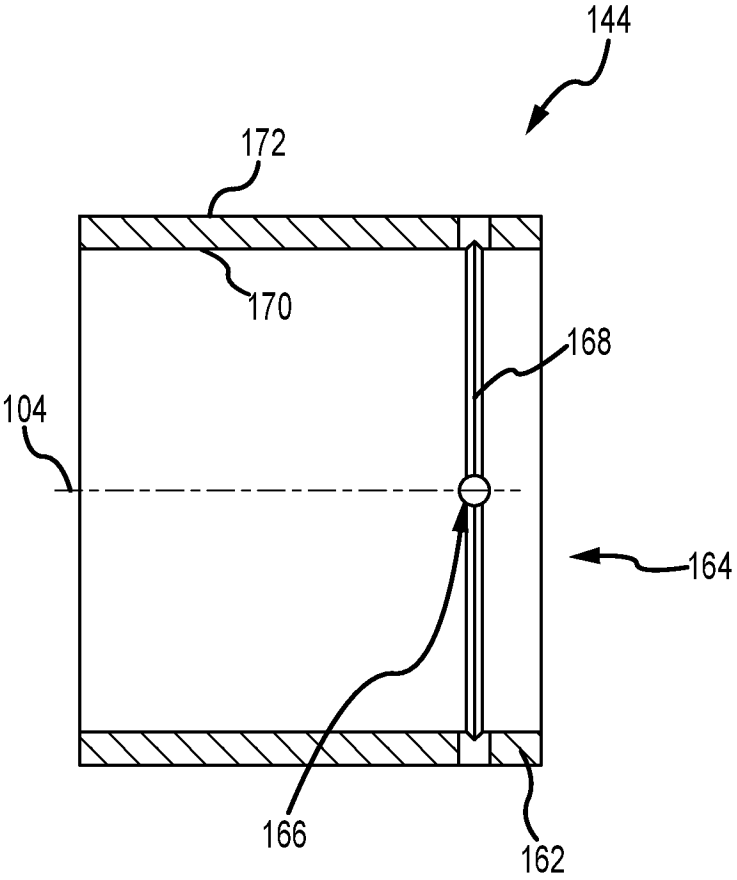
FIG. 6 is a cross-section view of the barrel shown in FIG. 5 taken on line 6-6.
Figure 5:
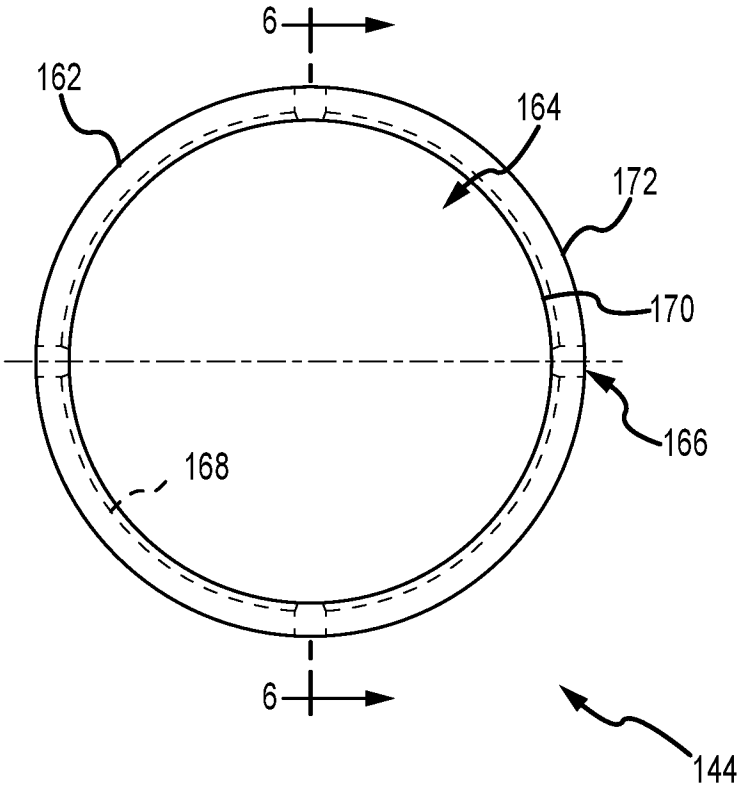
FIG. 5 is a top view of an exemplary barrel that may be used with the press apparatus shown in FIGS. 1-3.

FIGS. 5 and 6 are top and cross-section views of an exemplary barrel 144 that may be used with the press apparatus 100 (shown in FIGS. 1-3). The barrel 144 includes an annular cylinder body 162 extending along the actuation axis 104. The body 162 defines a central opening 164 therethrough that receives the barrel section 158 of the driven component 132 (shown in FIG. 4). The body 162 also defines a plurality of radial openings 166 and a plurality of recesses 168 defined in an inner circumferential surface 170 of the body 162 that extend between each opening 166. The barrel 144 is rotatably coupled around the driven component 132 and is rotatable about the actuation axis 104 independent from the adjustable dial 146. The ball nose spring plunger may be received within the radial openings 166 to rotatably secure the barrel 144 in relation to the driven component 132. The ball nose spring plunger also facilitates the barrel 144 rotating in relation to the driven component 132 by sliding within the recess 168. The body 162 also includes an outer circumferential surface 172 on which are located a plurality of axially spaced-apart hose size markings that correspond to hose types and which are described in further detail below.

Figure 7:
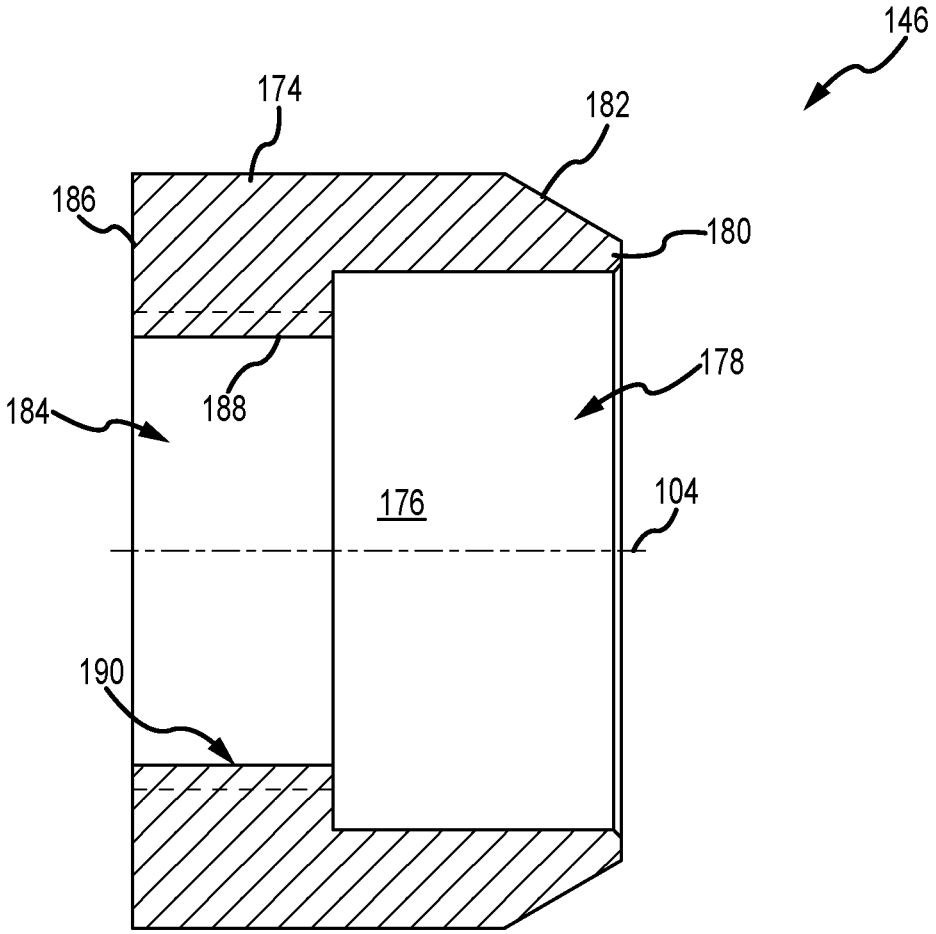
FIG. 7 is a cross-section view of an exemplary adjustable dial that may be used with the press apparatus shown in FIGS. 1-3.

FIG. 7 is a cross-section view of an exemplary adjustable dial 146 that may be used with the press apparatus 100 (shown in FIGS. 1-3). The dial 146 includes an annular cylinder body 174 extending along the actuation axis 104. The body 162 defines a central opening 176 therethrough that receives at least a portion of the second end 136 of the driven component 132 and the barrel 144 (shown in FIGS. 4-6). The central opening 176 includes a first opening section 178 disposed at a first end 180 of the body. The first opening 178 receives at least a portion of the barrel 144 and the driven component 132 such that the adjustable dial 146 is rotatable with respect to the barrel 144 and the driven component 132. The first end 180 includes an oblique section 182 such that the first end 180 is annularly frustoconical. The oblique section 182 includes a plurality of circumferentially spaced-apart hose size markings that correspond to hose types and which are described in further detail below.

The central opening 176 also includes a second opening section 184 disposed as a second end 186 of the body 174. An inner circumferential surface 188 of the body 174 at the second opening 184 includes threads 190 such that the adjustable dial 146 is threaded onto and coupled to the threaded section 154 of the driven component 132. As such, the adjustable dial 146 is rotatable with respect to the driven component 132 and is moveable axially with respect to the driven component 132 along the actuation axis 104.

Figure 8:
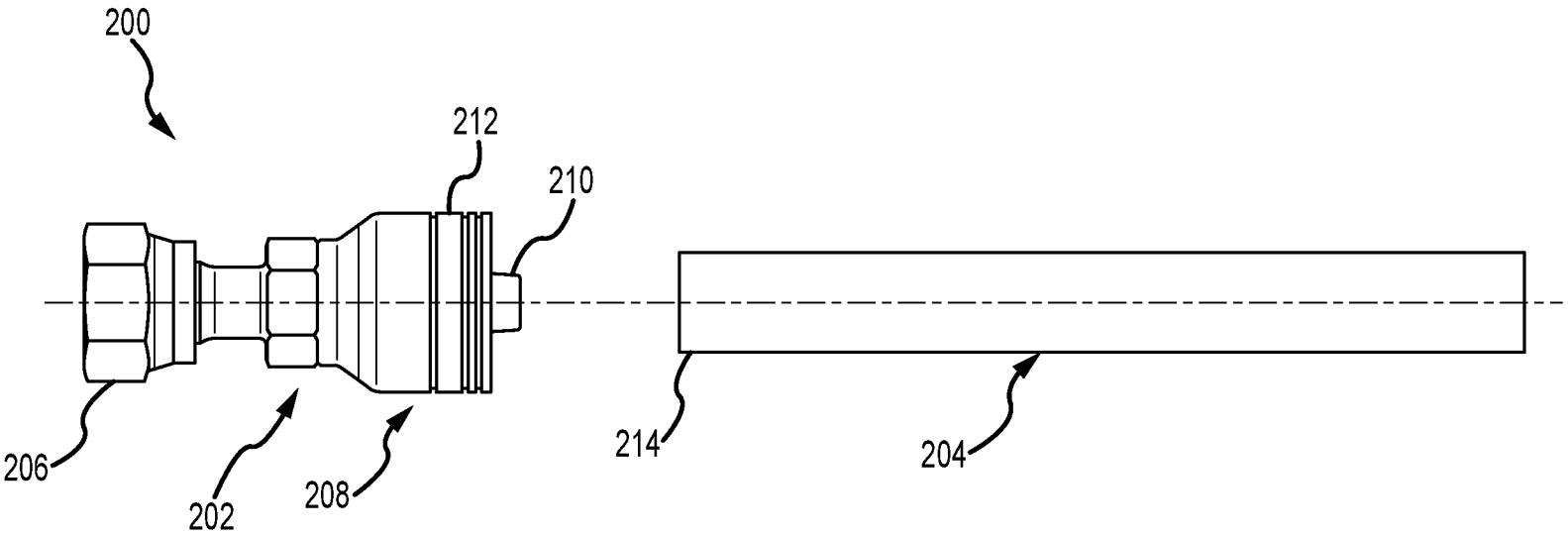
FIG. 8 is an exploded view of an exemplary hose assembly that may be used with the press apparatus shown in FIGS. 1-3.

FIG. 8 is an exploded view of an exemplary hose assembly 200 that may be used with the press apparatus 100 (shown in FIGS. 1-3). The hose assembly 200 includes the fitting assembly 202 and the hose 204. The fitting assembly 202 includes a first end 206 and an opposite second end 208. The second end 208 includes a nipple 210 and a socket 212 disposed at least partially around the nipple 210.

To join the fitting assembly 202 to the hose 204, a first end 214 of the hose 204 may be inserted around the nipple 210 and within the socket 212. The press apparatus 100 may then be utilized to crimp the fitting assembly 202 and secure the fitting assembly 202 to the hose 204 via the die assembly 300 (shown in FIGS. 9 and 10) as described in further detail below. Generally, the hose 204 may be identified with a part number and a diameter reference number. Similarly, the fitting assembly 202 is identified with a part number such that the fitting assembly is coded to, and matched to the corresponding hose type and size.

Figure 10:
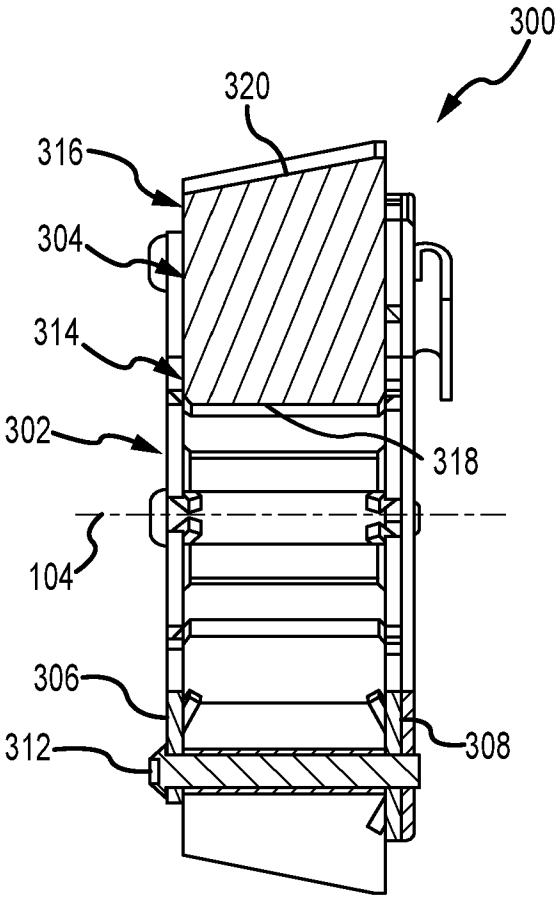
FIG. 10 is a side view of the die assembly shown in FIG. 9 taken on line 10-10.
Figure 9:
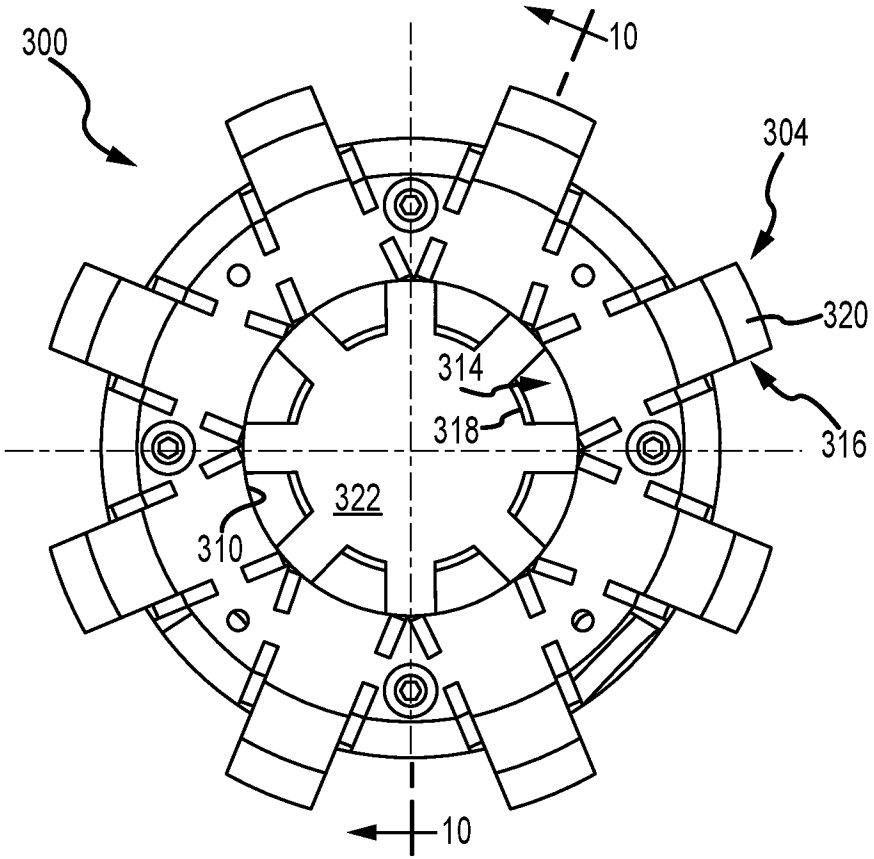
FIG. 9 is a top view of an exemplary die assembly that may be used with the press apparatus shown in FIGS. 1-3.

FIG. 9 is a top view of an exemplary die assembly 300 that may be used with the press apparatus 100 (shown in FIGS. 1-3). FIG. 10 is a side view of the die assembly 300 taken on line 10-10. Referring to FIGS. 9 and 10, the die assembly 300, also known as a crimp die set and identifiable via a part number, includes a die cage 302 and a plurality of dies 304. The die cage 302 includes a first plate 306 and a second plate 308, and each of the first and second plates 306, 308 defines a central opening 310. The first plate 306 is disposed at an offset relative to the second plate 308 via a plurality of fasteners 312. Each die 304 includes a first radial end 314 and an opposite second radial end 316. The first radial end 314 includes a crimp surface 318 having an arcuate shape. The second radial end 316 includes an actuation surface 320 having a tapered shape.

The dies 304 are circumferentially spaced about the longitudinal axis 104 between the first and second plates 306, 308. The dies 304 are adapted to selectively reciprocate in the die cage 302 between a retracted position and a crimp position. In the retracted position, the first radial ends 314 of the dies 304 extend into the central opening 310 of the first and second plates 306, 308, while the second radial ends 316 extend beyond an outer diameter of each of the first and second plates 306, 308. In the retracted position, the dies 304 define a center opening 322 that is adapted to receive the socket 212 of the hose assembly 200 (shown in FIG. 8).

In the crimp position, the first radial ends 314 of the dies 304 move radially inward into the central opening 310 of the first and second plates 306, 308. In the crimp position, the center opening 322 defined by the dies 304 has a circumference that is smaller than the circumference of the center opening 322 in the retracted position. In the exemplary embodiment, actuation of the die assembly 300 between the retracted position and the crimp position is induced by actual extension of the driven component 132 as discussed in further detail below.

Figure 11:
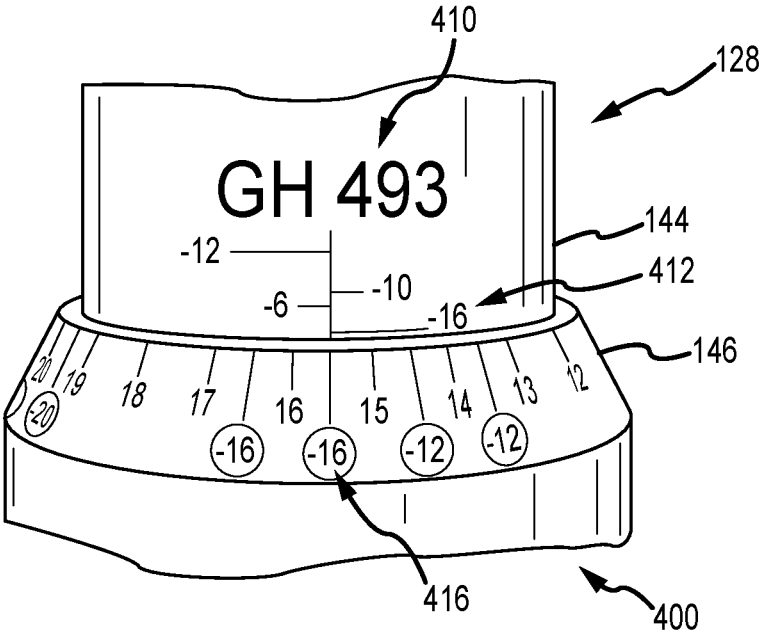
FIG. 11 is a detail view of an exemplary actuator adjustment assembly that may be used with the press apparatus shown in FIGS. 1-3 in a first position.
Figure 12:
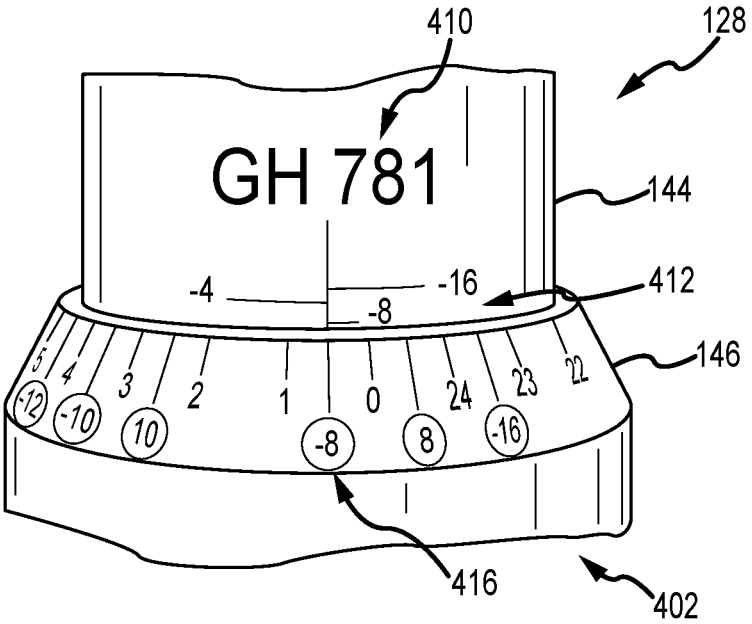
FIG. 12 is a detail view of the actuator adjustment assembly shown in FIG. 11 in a second position.
Figure 13:
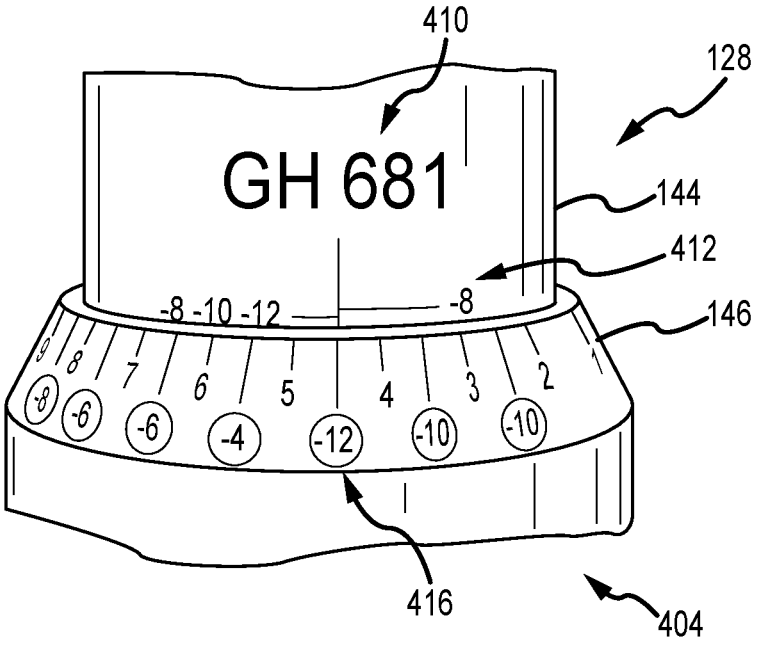
FIG. 13 is a detail view of the actuator adjustment assembly shown in FIG. 11 in a third position.
Figure 14:
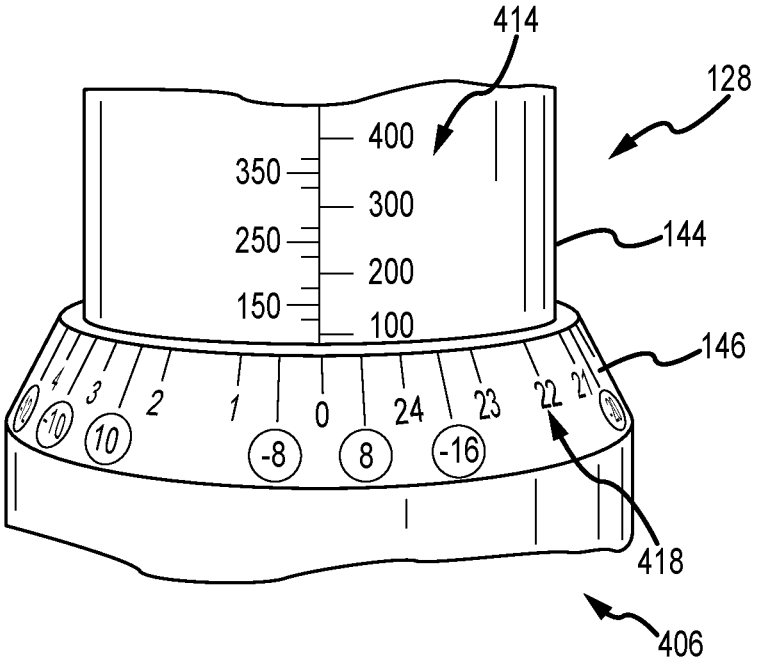
FIG. 14 is a detail view of the actuator adjustment assembly shown in FIG. 11 in a forth position.

FIG. 11 is a detail view of an exemplary actuator adjustment assembly 128 that may be used with the press apparatus 100 (shown in FIGS. 1-3) in a first position 400. FIG. 12 is a detail view of the actuator adjustment assembly 128 in a second position 402. FIG. 13 is a detail view of the actuator adjustment assembly 128 in a third position 404. FIG. 14 is a detail view of the adjustment assembly shown 128 in a forth position 406. FIG. 15 is a detail view of an exemplary set of crimp die set markings 408 that may be used with the actuator adjustment assembly 128 (shown in FIGS. 11-14). In operation, the press apparatus 100 may be variably adjusted, via the actuator adjustment assembly 128, such that the extension length of the driven component 132 is axially adjusted to desirably crimp the fitting assembly 202 to the hose 204 and increase a formation of a fitted connection joint while reducing undesirable over- and/or under-crimping.

More specifically, and referring to FIGS. 1-15, in operation, the hose 204 includes a hose type 410 that is identifiable with a part number and size reference. For example, the hose type 410 may be identifiable as GH493-16 (e.g., part number—hose size diameter in $16^{th}$ of an inch). With the hose type 410 known, the fitting assembly 202 and die assembly 300 may be determined via the crimp die set markings 408 (shown in FIG. 15). The crimp die set markings 408 may be located on the press apparatus 100 for ease of use or may be located in an operator manual. In the crimp die set markings 408 the hose type 410 is located in the first column, the fitting assembly 202 is in the second column, and the die assembly 300 is in the third column. As such, knowing the hose type 410, the fitting assembly 202 and the die assembly 300 may be determined via an easy to use look-up table. For example, a GH493-16 hose type 410 requires a 4S fitting assembly 202 and a M420 die assembly 300. Once the fitting assembly 202 and die assembly 300 are determined the identified parts may be retrieved for use with the press apparatus 100. For example, the first plate 306 of the required die assembly 300 is removably coupled to the second end 142 of the second frame 130 via a set of pins, and the nipple 210 of the fitting assembly 202 may be inserted within the hose 204 in preparation for the crimping process.

The crimp die set markings 408 may be visually arranged in groups according to hose type 410. For example, the crimp die set markings 408 illustrated in FIG. 15 are separated into three groups of hose identification numbers, GH681, GH781, and GH493, respectively. Each hose identification number is then ordered in a list of increasing diameter sizes. This facilitates a quick look up of the hose type identifiers and a determination of the required fitting assembly 202 and die assembly 300 parts. Additionally, the three groups may be color coded to further facilitate visual distinction of the hose type groups. For example, hose identification number GH681 may be colored as white, GH781 may be colored as green, and GH493 may be colored in orange. In the exemplary embodiment, three hose identification numbers are depicted and color coded, however, any other hose type identifiers, groups, colors, and visual indicators, such as numbers, letter, and/or symbols, may be used to facilitate a determination of the fitting assembly 202 and the die assembly 300 as described herein. Additionally, in alternative embodiments, the crimp die set markings 408 as a table look-up may include reference to any other component and/or part for use with the press assembly 100.

Once the required die assembly 300 is coupled to the second frame 130, the press assembly 126 may be adjusted to accommodate the hose type (GH493-16), the fitting assembly (4S), and the die assembly (M420) such that a desired crimp joint is formed. The driven component 132 is linearly actuatable between a retracted position and an extended crimping position along the actuation axis 104. The further the second end 136 axially extends toward the crimp ring 106 the further the dies 304 are radially displaced in the crimp position forming the crimp. If the dies 304 are not displaced enough, the fitting assembly 202 may be under-crimped and if the dies 304 are displaced too much, the fitting assembly 202 may be over-crimped, both of which are undesirable for the joint. Additionally, the axial depth of the die assembly 300 may vary and will need to be accounted for. As such, the actuator adjustment assembly 128 may be used to adjust the extension length of the second end 136 while in the extended position.

To set the actuator adjustment assembly 128, the barrel 144 is selectively rotated about the driven component 132 until the hose type 410 is positioned at a front side of the press apparatus 100. In the exemplary embodiment, the barrel 144 is divided into four radial sections on the outer circumferential surface 172 and each corresponding to the hose type 410, such as GH493 (FIG. 11, position 400), GH781 (FIG. 12, position 402), and GH681 (FIG. 13, position 404). For example, to crimp a GH493 hose, the barrel 144 is selectively rotated in position 400 (shown in FIG. 11). Each radial section of the barrel 144 also includes a set of axially spaced-apart hose size markings 412, corresponding to the hose type 410 and positioned adjacent thereto. The axially spaced-apart hose size markings 412 facilitate in the positioning of the adjustable dial 146 and setting the axial extension length of the driven component 132. Each set of axially spaced-apart size marking 412 are coded to correspond to the die assembly 300 that may be used therewith. Similar to the crimp die set markings 408, the axially spaced-apart hose size marking 412 may be color coded (white, green, and orange) to match the hose type 410 set forth in the crimp die set markings 408 and facilitate ease of use. Additionally, the barrel 144 may include a radial section with a generic set of axially spaced-apart measurement scale markings 414 in the position 406 (shown in FIG. 14) for use with other hose types. In alternative embodiments the axially spaced-apart hose size markings 412 and/or generic axially spaced-apart measurement scale marking 412 may use any other identifies, colors, or other visual indicators, such as numbers, letter, and/or symbols, to facilitate use of the press apparatus 100.

Once the barrel 144 is selectively rotated into a position that corresponds to the desired hose type 410, the adjustable dial 146 may be selectively rotated about the actuation axis 104 to adjust the axial extension length of the driven component 132 for use. The adjustable dial 146 includes a plurality of circumferentially spaced-apart hose size markings 416 sets positioned on the oblique section 182. Each set of circumferentially spaced-apart hose size marking 416 corresponds to the hose type 410 and are coded to correspond to the die assembly 300 that may be used. Similar to the crimp die set markings 408, each set of the circumferentially spaced-apart hose size markings 416 may be color coded (white, green, and orange) to match the hose type 410 set forth in the crimp die set markings 408 and the barrel 144 to facilitate ease of use. Additionally, the adjustable dial 146 may include a set of generic circumferentially spaced-apart hose size markings 418 (shown in FIG. 14) for use with other hose types. In alternative embodiments the circumferentially spaced-apart hose size markings 416 and/or generic circumferentially spaced-apart hose size marking 418 may use any other identifies, colors, or other visual indicators, such as numbers, letter, and/or symbols, to facilitate use of the press apparatus 100.

To set the actuator adjustment assembly 128 for using the press apparatus 100, the hose size in each of the axially spaced-apart hose size markings 412 on the barrel 144 is selectively matched in a cross-hair arrangement to a corresponding circumferentially spaced-apart hose size marking 416 on the adjustable dial 146, for the known hose type 410. For example, a hose type GH493-16 is positioned at 400 (FIG. 11) and the diameter (−16) is matched on both the barrel 144 via the corresponding axially spaced-apart hose size markings 412 and the adjustable dial 146 via the corresponding circumferentially spaced-apart hose size markings 416. Selectively rotating the adjustable dial 146 about the actuation axis 104, axially positions the adjustable dial 146 along the driven component 132 via the threaded connection. As the adjustable dial 146 moves axially towards the first end 134 of the driven component 132 the actuation length of the second end 136 increases and as the adjustable dial 146 moves axially away from the first end 134 the actuation length of the second end 136 decreases. When the driven component 132 is actuated and moves axially towards the crimp ring 106 towards its extended position, the second end 186 of the adjustable dial 146 contacts the first end 138 of the second frame 130 to set the actuation length of the driven component 132. As such, a pinch point location may be formed between the second frame 130 and the adjustable dial 146, and the pinch point hat 148 is positioned about the adjustable dial 146 to restrict access to this location.

Once the press apparatus 100 is set for use, the hose assembly 200 may be inserted within the central bore 112 of the crimp ring 106. The press assembly 126 may be actuated such that the driven component 132 is actuated by the actuator 122 and axially moves towards the crimp ring 106. As the driven component 132 is actuated, the center opening 322 of the die assembly 300 receives the hose assembly 200 and the dies 304 are radially displaced by slidingly engaging with the central bore inner surface 114 to crimp the fitting assembly 202 to the hose 204 and join the two components. This process may be repeated and the actuator adjustment assembly 128 adjusted for varying hose types.

As the driven component 132 is moved to the retracted position, the second frame 130 slides, via the elongated openings 156, towards the second end 136. This movement enables the actuator adjustment assembly 128 to be rotatable about the driven component 132 and the extension length to be set. Once the actuator adjustment assembly 128 is set and the driven component 132 is moved into the extension position, the second frame 130 may slide within the openings 156 towards the first end 134 until pressure can be applied via the actuator 122 to facilitate the crimping process. The driven component 132 continues to be moved into the extension position until stopped by the adjustable dial 146 position.

Figure 16:
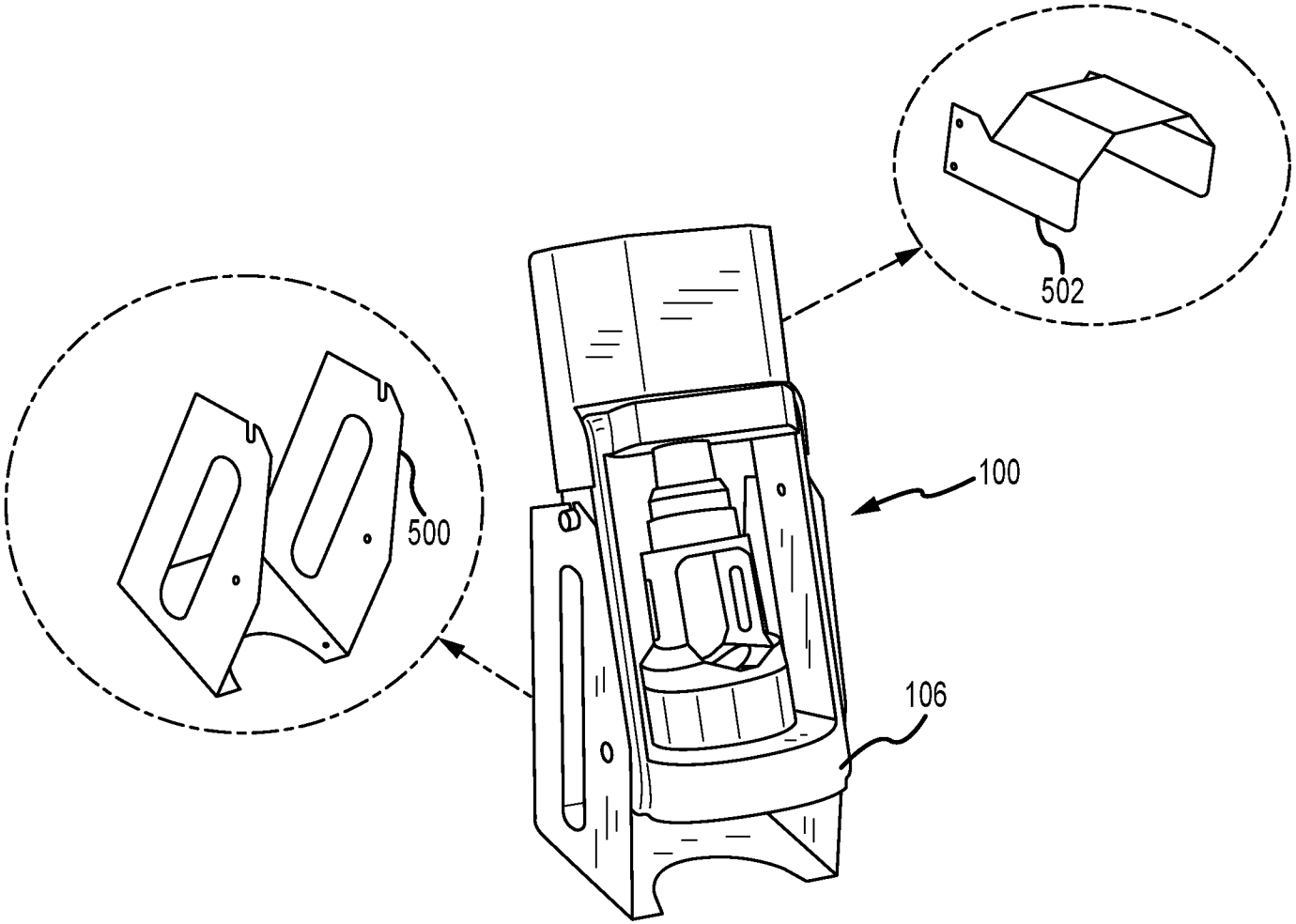
FIG. 16 is an exploded view of the press apparatus shown in FIGS. 1-3 including an exemplary bench mount.
Figure 17:
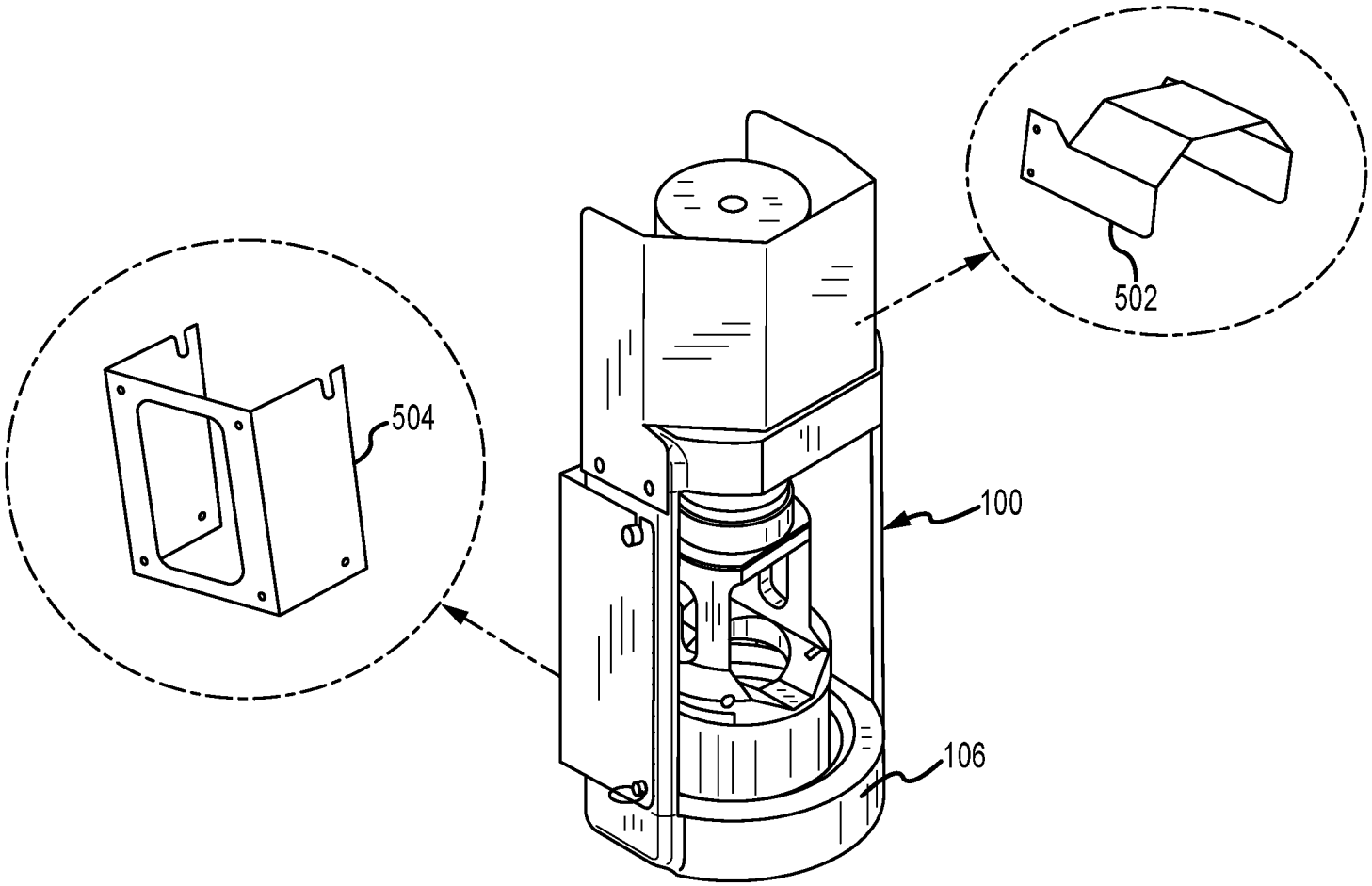
FIG. 17 is an exploded view of the press apparatus shown in FIGS. 1-3 including an exemplary wall mount.

FIG. 16 is an exploded view of the press apparatus 100 shown in FIGS. 1-3 including an exemplary bench mount 500. The press apparatus 100 may be rotatably coupled to the bench mount 500 such that the press apparatus 100 may be positionable, with the crimp ring 106 exposed, to facilitate inserting the fitting assembly 202 and hose 204 therethrough. The bench mount 500 may be securable to a flat surface (not shown) for using the press apparatus 100. The press apparatus 100 also includes a housing 502 that is coupled thereto for protecting the actuator 122 (shown in FIGS. 1-3). FIG. 17 is an exploded view of the press apparatus 100 shown in FIGS. 1-3 including an exemplary wall mount 504. The press apparatus 100 may be coupled to the wall mount 504 such that the press apparatus is securable to a wall (not shown) for using the press apparatus 100.

The actuation adjustment assembly described herein enables the press apparatus to be used for a plurality of hose types and diameters without the need to reference additional manuals or reference sources. As such, the embodiments described herein provide an economical and efficient press apparatus. Additionally, the actuation adjustment assembly includes two main moving parts thereby increasing durability and ease of use in the field.

Various modification and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A variable crimp machine for crimping fittings on hoses, the variable crimp machine comprising:

a first frame including an upper actuator mount and a lower crimp ring;

an actuator that mounts at the upper actuator mount, the actuator including a driven component that reciprocates linearly along an actuation axis which extends between the upper actuator mount and the lower crimp ring, the driven component including a lower end positioned below the upper actuator mount;

a second frame that attaches to the lower end of the driven component, the second frame defining a crimp die set mounting location;

an actuator adjustment assembly including a dial rotatably coupled to the driven component and that rotates about the actuation axis, the actuator adjustment assembly also including a barrel rotatably coupled to the driven component about the actuation axis and positioned along the actuation axis at least partially within the dial, wherein both the dial and the barrel are mounted directly on the driven component, the dial being configured to move axially relative to the barrel along the actuation axis as the dial is rotated about the actuation axis, and wherein the barrel is independently rotatable from the dial;

the barrel including a first set of axially spaced-apart hose size markings corresponding to a first type of hose and a second set of axially spaced-apart hose size markings correspond to a second type of hose;

the dial including a first set of circumferentially spaced-apart hose size markings corresponding to the first type of hose and a second set of circumferentially spaced-apart hose size markings corresponding to the second type of hose, wherein the first set of circumferentially spaced-apart hose size markings are used in concert with the first set of axially spaced-apart hose size markings to adjust the actuator for use with the first type of hose, and wherein the second set of circumferentially spaced-apart hose size markings are used in concert with the second set of axially spaced-apart hose size markings to adjust the actuator for use with the second type of hose.

2. The variable crimp machine of claim 1, wherein the first set of circumferentially spaced-apart hose size markings are coded with respect to the first set of axially spaced-apart hose size markings, and wherein the second set of circumferentially spaced-apart hose size markings are coded with respect to the second set of axially spaced-apart hose size markings.

3. The variable crimp machine of claim 1, wherein the first set of circumferentially spaced-apart hose size markings are color coded with respect to the first set of axially spaced-apart hose size markings, and wherein the second set of circumferentially spaced-apart hose size markings are color coded with respect to the second set of axially spaced-apart hose size markings.

4. The variable crimp machine of claim 1, further comprising a generic set of measurement scale markings spaced circumferentially on the dial and a corresponding generic set of measurement scale markings spaced axially on the barrel.

5. The variable crimp machine of claim 4, wherein the generic set of measurement scale markings are interspersed with the first set of circumferentially spaced-apart hose size markings and the second set of circumferentially spaced-apart hose size markings.

6. The variable crimp machine of claim 1, further comprising a plurality of crimp die sets that can be mounted at the crimp die set mounting location, the crimp die sets correspond to different hose sizes.

7. The variable crimp machine of claim 6, further comprising a set of crimp die set markings, the crimp die set markings relate crimp die sets to hose sizes.

8. The variable crimp machine of claim 7, wherein the first set of circumferentially spaced-apart hose size markings are coded with respect to the first set of axially spaced-apart hose size markings and to the crimp die set markings, and wherein the second set of circumferentially spaced-apart hose size markings are coded with respect to the second set of axially spaced-apart hose size markings and to the crimp die set markings.

9. The variable crimp machine of claim 6, further comprising a set of crimp die set markings, the crimp die set markings relate crimp die sets to hose sizes and to fitting assemblies.

10. The variable crimp machine of claim 1, wherein the first and second sets of axially spaced-apart hose size markings are circumferentially offset from one another, and wherein the barrel can be rotated about the actuation axis to selectively face either the first or second set of axially spaced-apart hose size markings at a front side of the variable crimp machine.

11. The variable crimp machine of claim 1, wherein the dial is threadably coupled to the driven component so as to drive axial movement of the dial when rotated about the actuation axis.

12. The variable crimp machine of claim 1, wherein the dial comprises an oblique section proximate an upper end, the first set of circumferentially spaced-apart hose size markings and the second side of circumferentially spaced-apart hose size markings interspersed on the oblique section.

13. The variable crimp machine of claim 1, wherein the dial is rotatable in relation to both the driven component and the barrel.

14. The variable crimp machine of claim 1, further comprising a pinch point hat coupled to the second frame and at least partially surrounding the dial thereby restricting access to a lower end of the dial.

15. An actuator adjustment assembly for a variable crimp machine, the actuator adjustment assembly comprising:

a dial that is rotatable about an actuation axis, the dial threadably engageable with a driven component of the variable crimp machine that reciprocates linearly along the actuation axis; and a barrel rotatably couplable to the driven component and disposed at least partially between the dial and the driven component, wherein as the dial is rotated about the actuation axis, the dial moves axially relative to the barrel along the actuation axis, and wherein the barrel is rotatable about the actuation axis independently from the dial;

the dial comprising a plurality of circumferentially spaced-apart hose size markings corresponding to a plurality of hose types;

the barrel comprising a plurality of axially spaced-apart hose size markings corresponding to the plurality of hose types, wherein the plurality of circumferentially spaced-apart hose size markings are used in concert with the plurality of axially spaced-apart hose size markings to adjust an extension length of the driven component.

16. The actuator adjustment assembly of claim 15, wherein the plurality of circumferentially spaced-apart hose size markings comprises two or more marking sets and the plurality of axially spaced-apart hose size markings comprises two or more marking sets, and wherein corresponding markings sets between the plurality of circumferentially spaced-apart hose size markings and the plurality of axially spaced-apart hose size markings are coded.

17. The actuator adjustment assembly of claim 16, wherein corresponding marking sets between the plurality of circumferentially spaced-apart hose size markings and the plurality of axially spaced-apart hose size markings are color coded.

18. The actuator adjustment assembly of claim 15, further comprising a set of crimp die set markings that relate crimp die sets to hose sizes and fitting assemblies.

19. The actuator adjustment assembly of claim 18, wherein the plurality of circumferentially spaced-apart hose size markings comprises two or more marking sets and the plurality of axially spaced-apart hose size markings comprises two or more marking sets, and wherein the set of crimp die set markings are coded to corresponding marking sets between the plurality of circumferentially spaced-apart hose size markings and the plurality of axially spaced-apart hose size markings.

20. A variable crimp machine for crimping fittings on hoses, the variable crimp machine comprising:

a first frame including an upper actuator mount and a lower crimp ring;

an actuator that mounts at the upper actuator mount, the actuator including a driven component that reciprocates linearly along an actuation axis which extends between the upper actuator mount and the lower crimp ring, the driven component including a lower end positioned below the upper actuator mount;

a second frame that attaches to the lower end of the driven component, the second frame defining a crimp die set mounting location;

an actuator adjustment assembly including a dial rotatably coupled to the driven component and that rotates about the actuation axis, the actuator adjustment assembly also including a barrel coupled to the driven component and positioned along the actuation axis within the dial, the dial being configured to move axially relative to the barrel along the actuation axis as the dial is rotated about the actuation axis;

the barrel including a first set of axially spaced-apart hose size markings corresponding to a first type of hose and a second set of axially spaced-apart hose size markings correspond to a second type of hose;

the dial including a first set of circumferentially spaced-apart hose size markings corresponding to the first type of hose and a second set of circumferentially spaced-apart hose size markings corresponding to the second type of hose, wherein the first set of circumferentially spaced-apart hose size markings are used in concert with the first set of axially spaced-apart hose size markings to adjust the actuator for use with the first type of hose, and wherein the second set of circumferentially spaced-apart hose size markings are used in concert with the second set of axially spaced-apart hose size markings to adjust the actuator for use with the second type of hose; and a pinch point hat coupled to the second frame and at least partially surrounding the dial thereby restricting access to a lower end of the dial.

* * * * *